US006626214B1

(12) United States Patent
Hu

(10) Patent No.: US 6,626,214 B1
(45) Date of Patent: Sep. 30, 2003

(54) CUTTER FOR A WOOD PLANING MACHINE

(76) Inventor: Teng-Fu Hu, No. 15, Kuang-Ming 5th Lane, Nan Dist., Taichung City (TW)

( * ) Notice: Subject to any disclaimer, the term of this patent is extended or adjusted under 35 U.S.C. 154(b) by 0 days.

(21) Appl. No.: 10/227,249

(22) Filed: Aug. 26, 2002

(30) Foreign Application Priority Data

Jul. 19, 2002 (TW) ..... 91211064 U

(51) Int. Cl.[7] ..... B27G 13/00

(52) U.S. Cl. ..... 144/221; 144/218; 144/117.1; 144/230; 144/241; 407/42; 407/63; 407/41

(58) Field of Search ..... 144/218, 221, 144/225, 226, 227, 230, 241, 114.1, 117.1; 407/41, 42, 46, 47, 51, 52, 63, 37

(56) References Cited

U.S. PATENT DOCUMENTS

| | | | | | |
|---|---|---|---|---|---|
| 811,768 | A | * | 2/1906 | Forbes | 144/221 |
| 909,122 | A | * | 1/1909 | Roussell | 144/221 |
| 1,021,202 | A | * | 3/1912 | Marsh | 144/221 |
| 4,253,506 | A | * | 3/1981 | Shimohira | 144/221 |
| 4,485,858 | A | * | 12/1984 | Cecchi | 144/221 |
| 4,830,073 | A | * | 5/1989 | De Abreu | 144/221 |
| 6,367,523 | B1 | * | 4/2002 | Hu | 144/230 |

* cited by examiner

*Primary Examiner*—W. Donald Bray
(74) *Attorney, Agent, or Firm*—Morgan, Lewis & Bockius LLP

(57) ABSTRACT

A cutter for a wood planing machine includes a block piece having a blade-mounting face that is formed with a positioning groove, and a blade attached to the blade-mounting face and having a plurality of positioning tabs projecting into and engaging the positioning groove.

4 Claims, 10 Drawing Sheets

CUTTER FOR A WOOD PLANING MACHINE

CROSS-REFERENCE TO RELATED APPLICATION

This application claims priority of Taiwanese Application No. 091211064, filed on Jul. 19, 2002.

BACKGROUND OF THE INVENTION

1. Field of the Invention

This invention relates to a cutter for a wood planing machine, more particularly to a cutter that is adapted to be installed in a wood planing machine and that includes a blade with a plurality of positioning tabs.

2. Description of the Related Art

FIGS. 1 and 2 illustrate a conventional cutter of a wood planing machine to be driven by a motor (not shown) for planing a wooden workpiece (not shown). The cutter includes an elongated blade supporting block piece 100 that is generally cylindrical in shape and that is formed with a plurality of blade-mounting grooves 102, and a plurality of blades 2 respectively mounted in the blade-mounting grooves 102. A plurality of screw bolts 3 threadedly engage the block piece 100, and abut respectively against the blades 2 so as to retain and fasten the blades 2 in the blade-mounting grooves 102.

The conventional cutter is disadvantageous in that the blades 2 tend to be misaligned in the respective blade-mounting grooves 102 during a planing operation. Moreover, since all of the points of a cutting edge of each blade 2 are simultaneously in contact with the workpiece during the planing operation, the friction force between each blade 2 and the workpiece is relatively large, thereby considerably increasing the load of the motor.

SUMMARY OF THE INVENTION

Therefore, it is an object of the present invention to provide a cutter that is adapted to be installed in a wood planing machine and that is capable of overcoming the aforesaid drawbacks.

According to the present invention, a cutter is adapted to be installed in a wood planing machine, and comprises: an elongated block piece having two opposite ends, a blade-mounting face that extends along the length of the block piece between the ends of the block piece, and a positioning groove that is indented inwardly from the blade-mounting face in a transverse direction relative to the blade-mounting face and that extends along the length of the blade-mounting face so as to divide the blade-mounting face into opposite first and second mounting-portions, the positioning groove being defined by a groove-confining wall; and a flexible elongated blade having a first side portion attached to the first mounting-portion, a second side portion attached to the second mounting-portion, an intermediate portion interconnecting the first and second side portions and disposed over and aligned with the positioning groove, and a plurality of spaced apart positioning tabs which are aligned along the length of the positioning groove, which project from the intermediate portion into the positioning groove, and which abut against the groove-confining wall so as to enhance positioning of the blade at the block piece prior to fastening of the blade to the block piece.

BRIEF DESCRIPTION OF THE DRAWINGS

In drawings which illustrate embodiments of the invention.

DETAILED DESCRIPTION OF THE PREFERRED EMBODIMENTS

Figure 1:
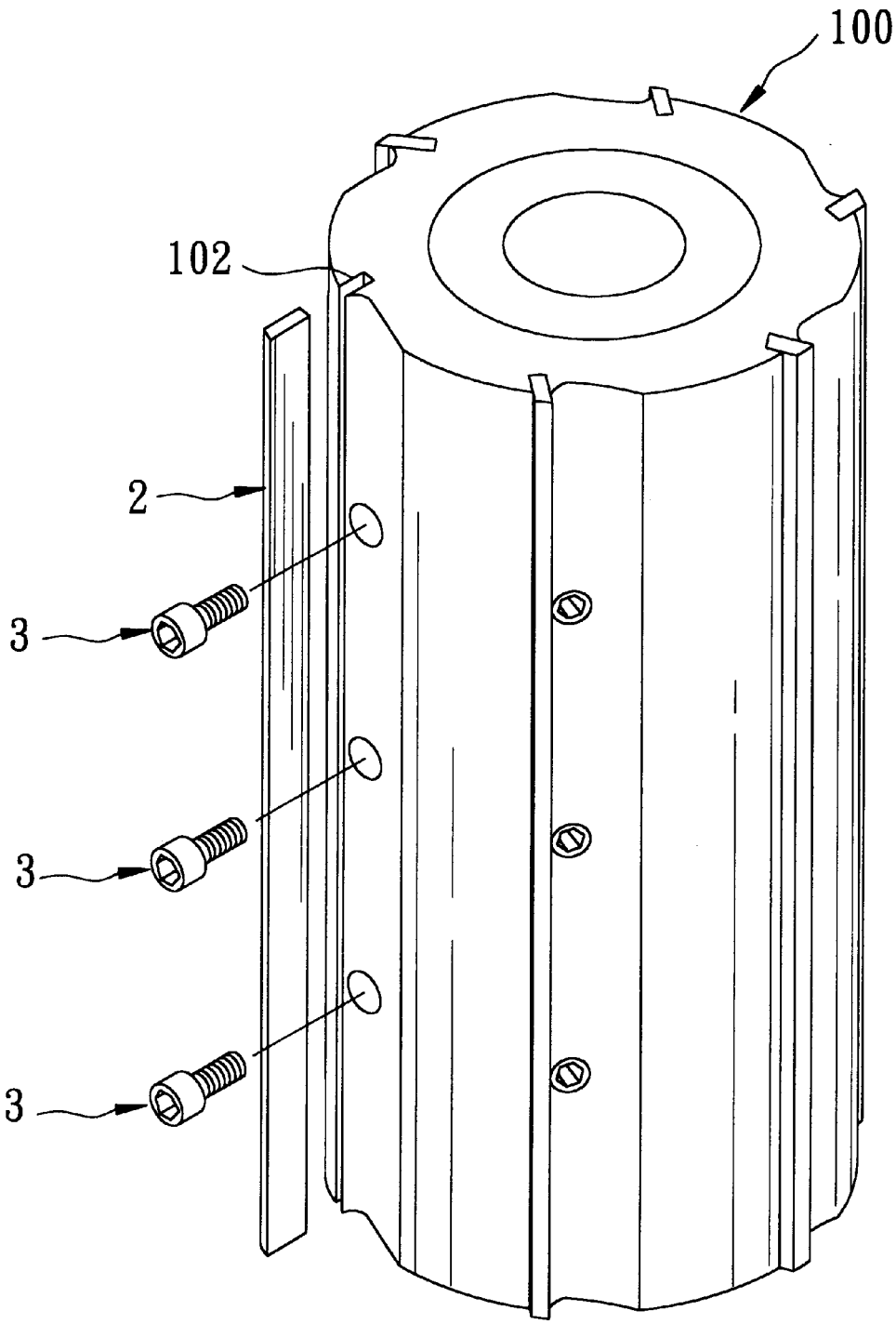
FIG. 1 PRIOR ART
FIG. 1 is a partly exploded, perspective view of a conventional cutter for a wood planing machine.
Figure 2:
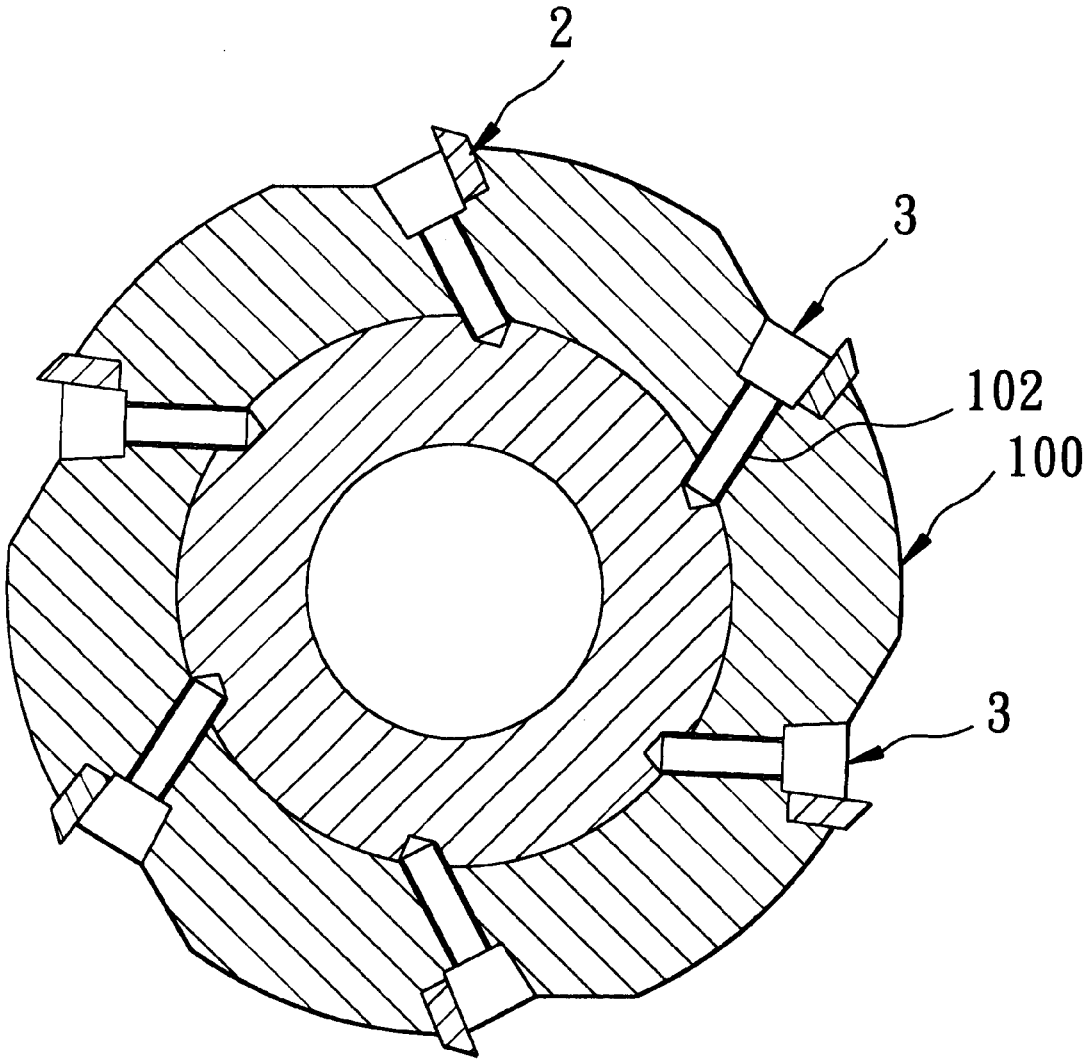
FIG. 2 PRIOR ART
FIG. 2 is a cross-sectional view of the cutter of FIG. 1.
Figure 3:
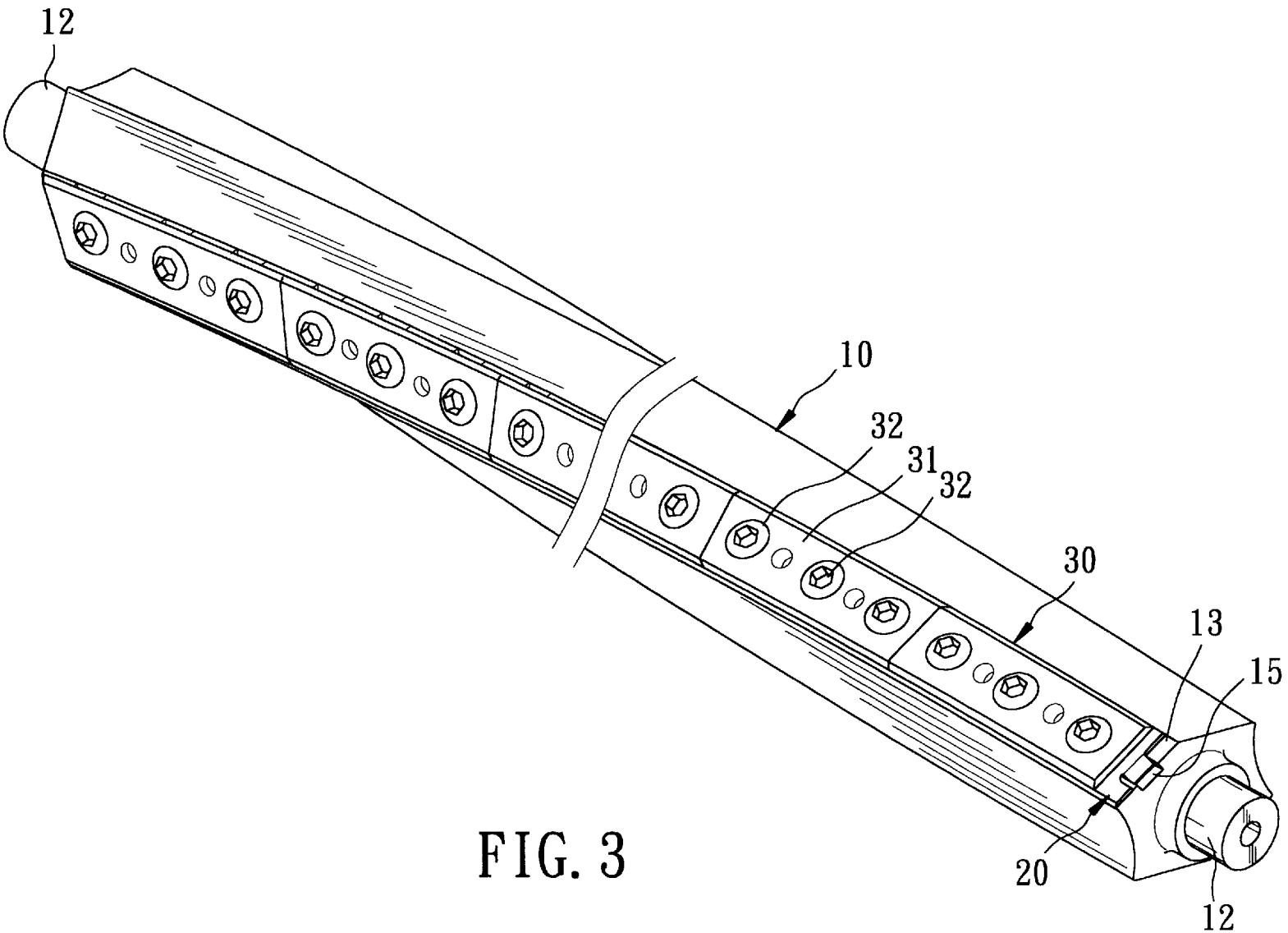
FIG. 3 is a perspective view of a first preferred embodiment of a cutter for a wood planing machine according to this invention.
Figure 4:
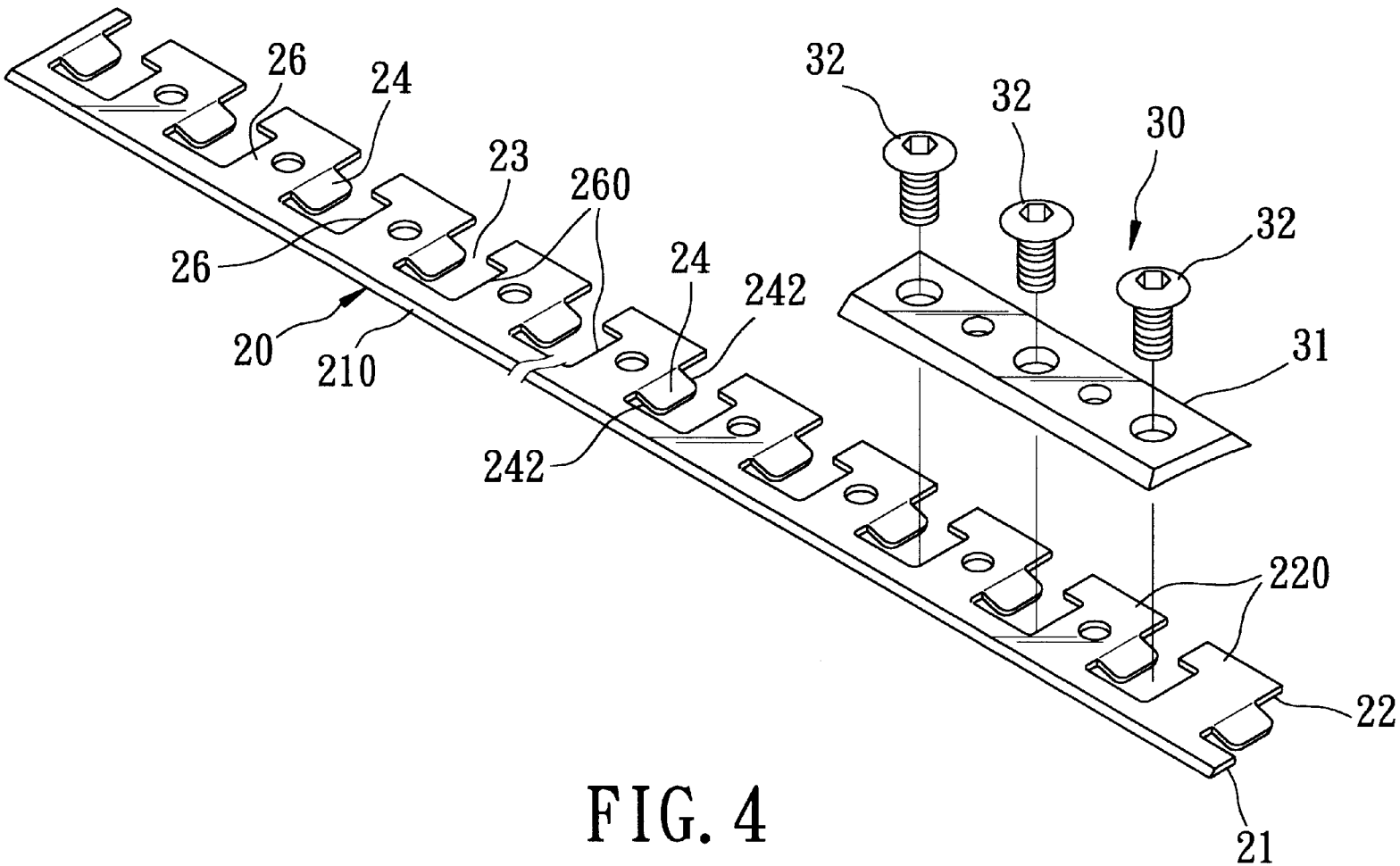
FIG. 4 is an exploded perspective view of a blade and a fastener unit of the cutter of FIG. 3.
Figure 5:
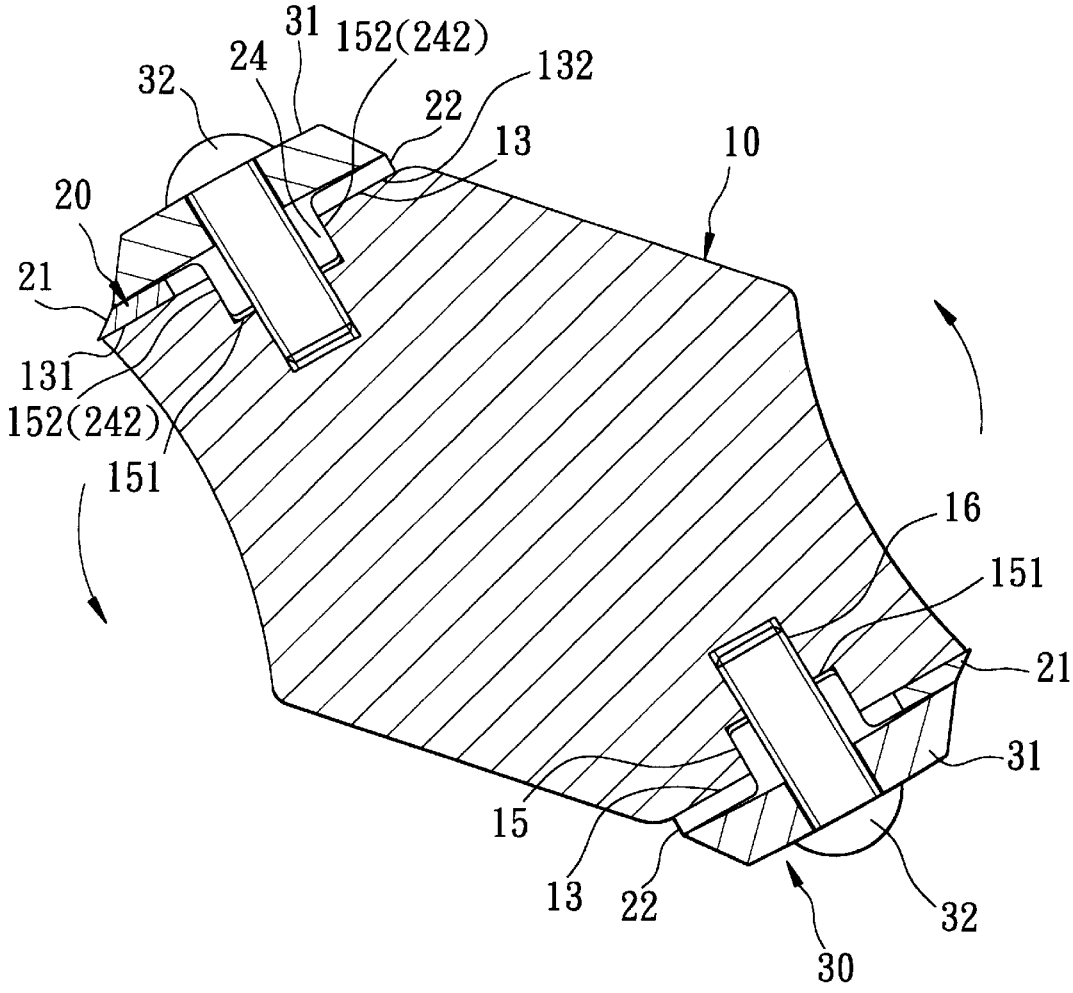
FIG. 5 is a cross-sectional view of the cutter of FIG. 3.
Figure 6:
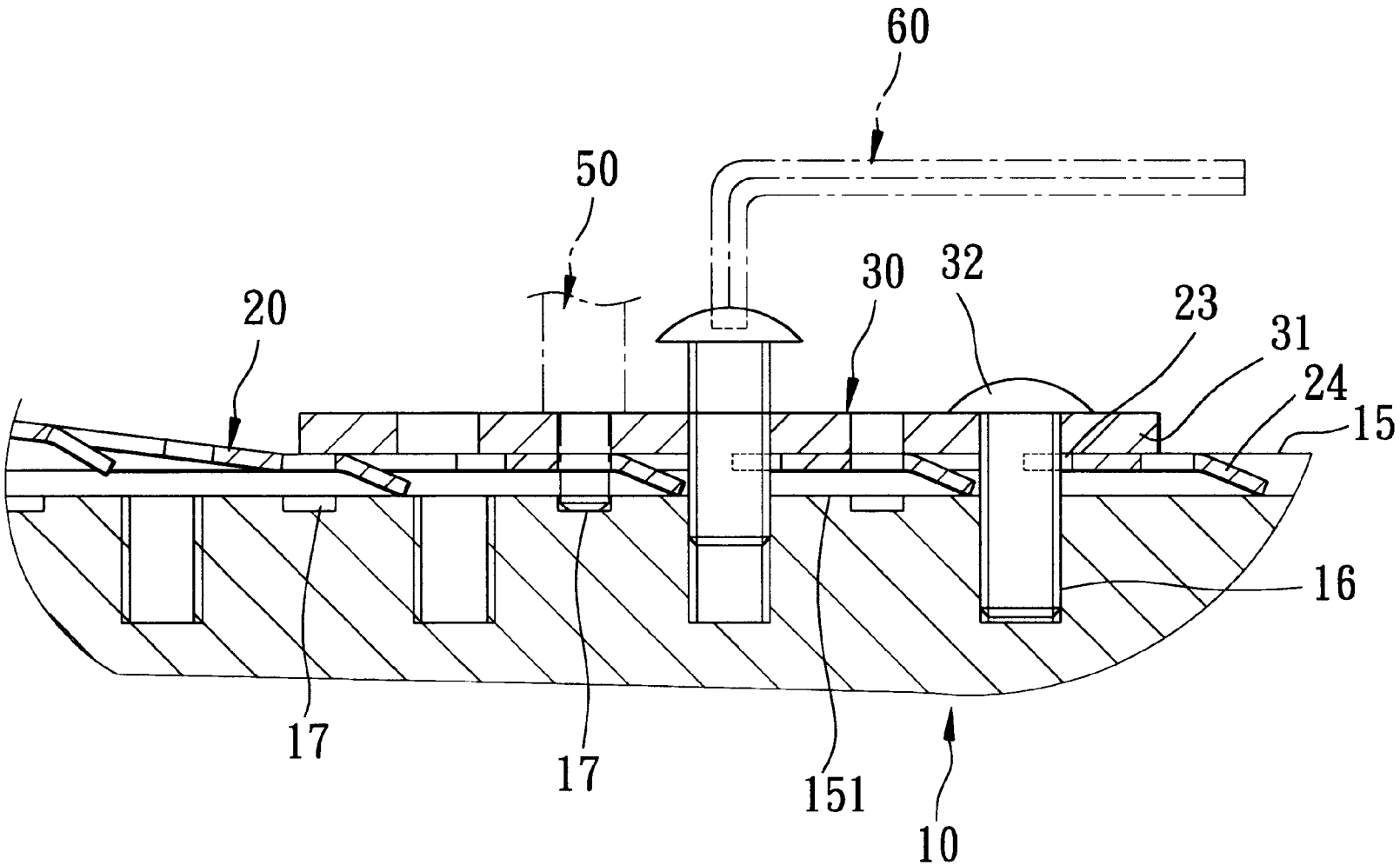
FIG. 6 is a fragmentary sectional schematic side view of the cutter of FIG. 3.
Figure 7:
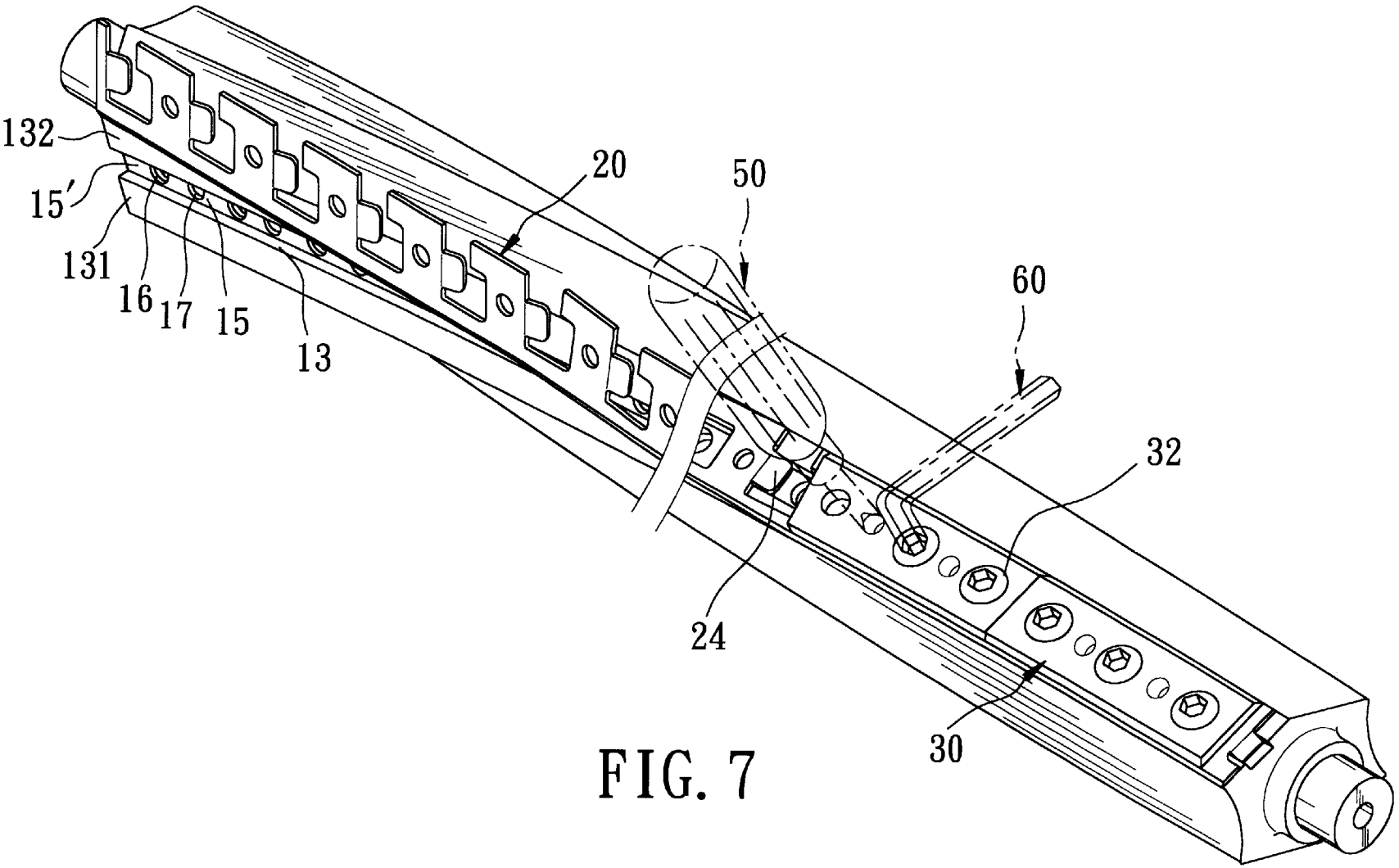
FIG. 7 is a perspective view to illustrate how the blade is secured to a block piece of the cutter of FIG. 3 via a tool.

For the sake of brevity, like elements are denoted by the same reference numerals throughout the disclosure.

FIGS. 3 to 7 illustrate a first preferred embodiment of a cutter for a wood planing machine according to this invention. The cutter includes: an elongated block piece 10 having two opposite ends 12, a pair of opposite blade-mounting faces 13 that extend along the length of the block piece 10 between the ends 12 of the blockpiece 10, and a pair of positioning grooves 15, each of which is indented inwardly from a respective one of the blade-mounting faces 13 in a transverse direction relative to the respective blade-mounting face 13 and each of which extends along the length of the respective blade-mounting face 13 so as to divide each of the blade-mounting faces 13 into opposite first and second mounting-portions 131, 132, each of the positioning grooves 15 being defined by a groove-confining wall 15'; and a pair of flexible elongated blades 20, each of which has a first side portion 21 attached to the first mounting-portion 131 of a respective one of the blade-mounting faces 13, a second side portion 22 attached to the second mounting-portion 132 of the respective blade-mounting face 13, an intermediate portion 26 interconnecting the first and second side portions 21, 22 and disposed over and aligned with a respective one of the positioning grooves 15, and a plurality of spaced apart positioning tabs 24 which are aligned along the length of the respective positioning groove 15, which project from the intermediate portion 26 into the respective positioning groove 15, and which abut against the groove-confining wall 15' of the respective positioning groove 15 so as to enhance positioning of the blades 20 at the block piece 10 prior to fastening of the blade 20 to the block piece 10.

The block piece 10 is rotatable about a rotation axis. Each of the blade-mounting faces 13 is helically twisted about the rotation axis. In this embodiment, the first side portion 21 of each of the blades 20 is formed with a cutting edge 210. Each of the blades 20 is formed with a plurality of spaced apart first notches 23 which are aligned along the length of the respective blade 20. Each of the first notches 23 extends from the second side portion 22 of the respective blade 20 toward the first side portion 21 of the respective blade 20 so as to divide the intermediate portion 26 of the respective blade 20 into a plurality of spaced apart tab-connecting sections 260 that are aligned along the length of the respective blade 20, so as to divide the second side portion 22 of the respective blade 20 into a plurality of spaced apart attaching sections 220 that are aligned along the length of the respective blade 20 and that are attached to the second mounting-portion 132 of the respective blade-mounting face 13, and so as to enhance flexibility of the blades 20 for conforming to the helical shape of the blade-mounting faces 13. The groove-confining wall 15' of each positioning groove 15 includes a base portion 151 confronting the intermediate portion 26 of the respective blade 20 and having two opposite ends, and two opposite side portions 152 that transversely and respectively extend from the opposite ends of the base portion 151. Each of the positioning tabs 24 is bent from a respective one of the tab-connecting sections 260 of the intermediate portion 26 of the respective blade 20, projects inclinedly therefrom into the respective positioning groove 15, and has two opposite sides 242 that abut respectively against the opposite side portions 152 of the groove-confining wall 15' of the respective positioning groove 15.

The base portion 151 of the groove-confining wall 15' of each positioning groove 15 is formed with a plurality of screw holes 16 that are aligned with the first notches 23, respectively, and a plurality of positioning holes 17. A fastening unit 30 includes a plurality of fastening plates 31 which are attached to and which are aligned in series along the length of a respective one of the blades 20, and a plurality of screw bolts 32 respectively extending through the fastening plates 31 and the first notches 23 and threadedly and respectively engaging the screw holes 16 in the base portion 151 of the groove-confining wall 15' of a respective positioning groove 15 so as to fasten the blades 20 to the block piece 10. Each of the fastening plates 31 has a bottom face of a helical shape that conforms to the shape of a respective one of the blade-mounting faces 13. A positioning tool 50 is inserted through a selected one of the fastening plates 31 and into a selected one of the positioning holes 17 for facilitating tightening of the blades 20 at the respective blade-mounting face 13 via a tightening tool 60 (see FIGS. 6 and 7).

Figure 8:
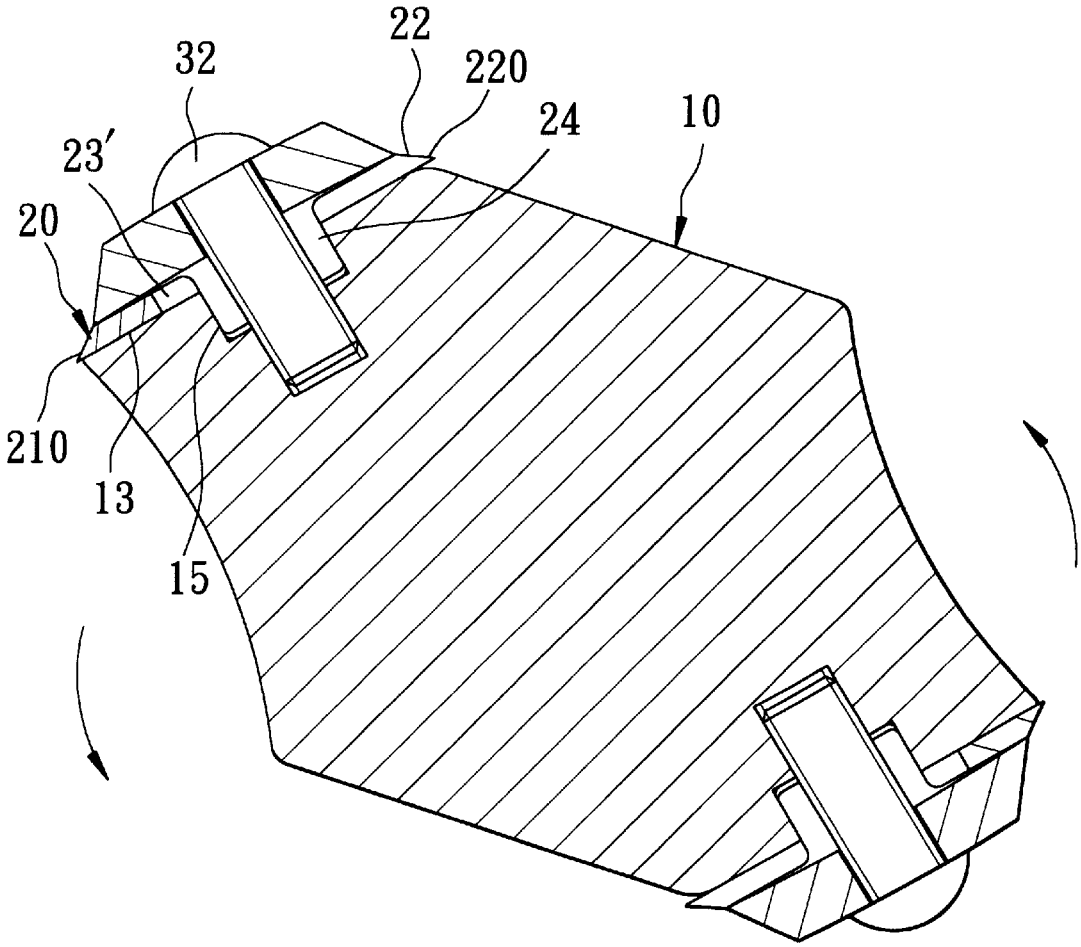
FIG. 8 is a cross-sectional view of a second preferred embodiment of the cutter according to this invention.
Figure 9:
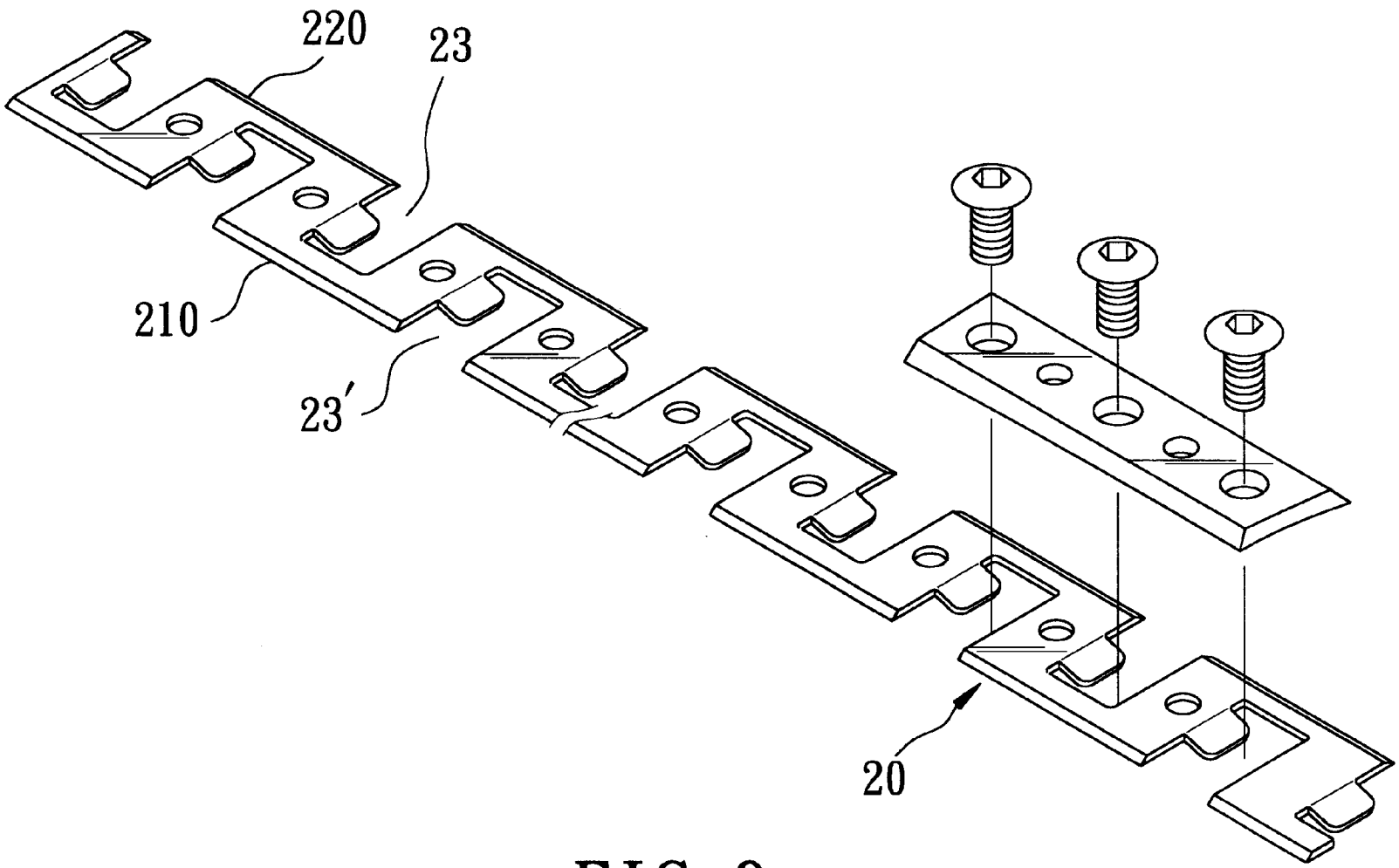
FIG. 9 is an exploded perspective view of the blade and the fastener unit of the cutter of FIG. 8.
Figure 10:
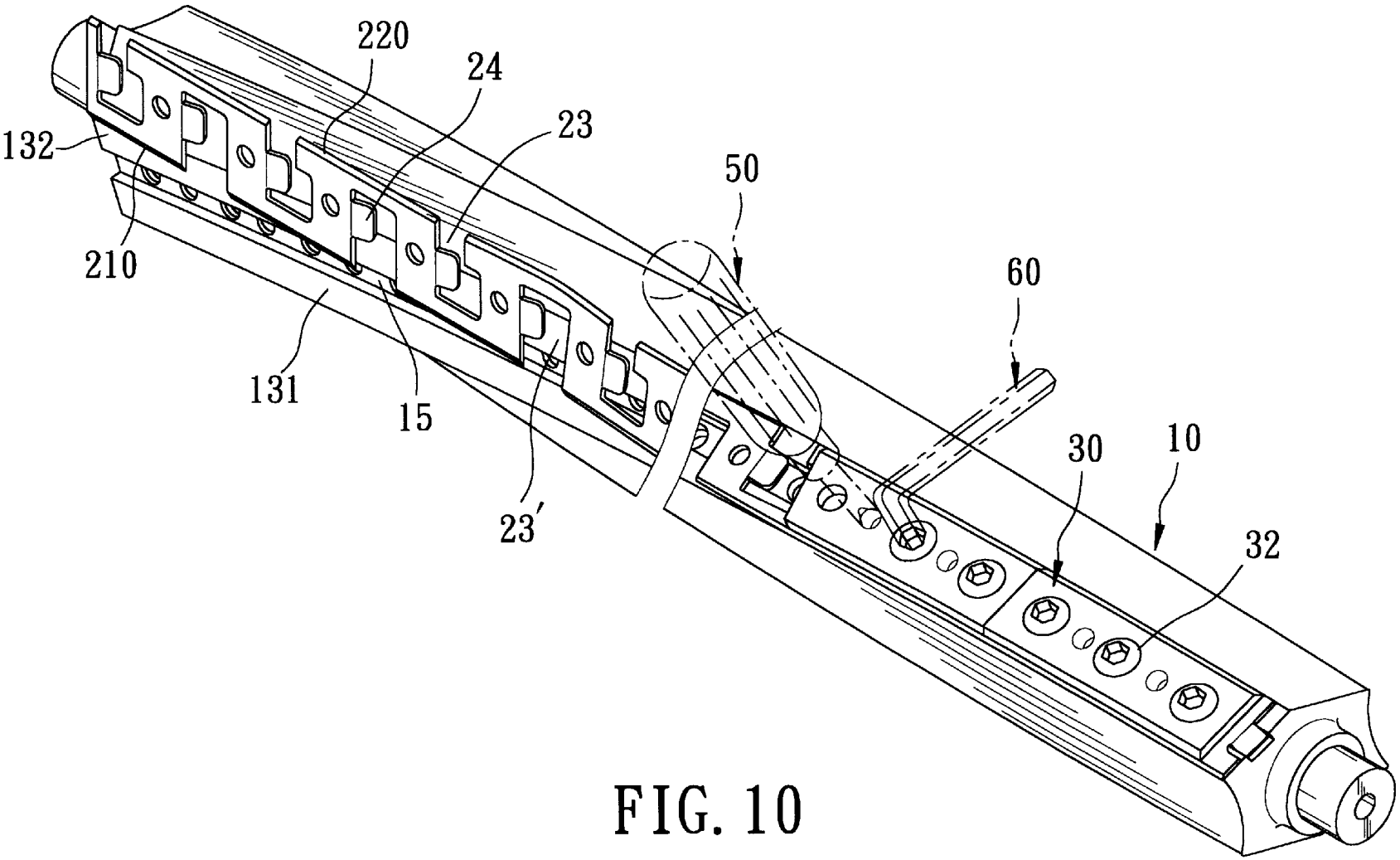
FIG. 10 is a perspective view to illustrate how the blade is fastened to the block piece of the cutter of FIG. 8.

FIGS. 8 to 10 illustrate a second preferred embodiment of the cutter according to this invention. The cutter of this embodiment is similar to the previous embodiment shown in FIG. 3, except that the second side portion 22 of each of the blades 20 is formed with a cutting edge 220, and that each of the blades 20 is further formed with a plurality of second notches 23', each of which extends from the first side portion 21 of the respective blade 20 toward the second side portion 22 of the respective blade 20. The first and second notches 23, 23' are alternately disposed along the length of the respective blade-mounting face 13.

With the design of the positioning grooves 15 and the positioning tabs 24 in the cutter according to this invention, the aforesaid blade alignment problem as encountered in the prior art can be eliminated. Moreover, since each of the blades 20 extends helically about the rotation axis, the aforesaid friction force between each blade and a workpiece can be considerably reduced.

With the invention thus explained, it is apparent that various modifications can be made without departing from the spirit of the present invention. It is therefore intended that the invention be limited only as recited in the appended claims.

I claim:

1. A cutter adapted to be installed in a wood planing machine, comprising:

an elongated block piece having two opposite ends, a blade-mounting face that extends along the length of said block piece between said ends of said block piece, and a positioning groove that is indented inwardly from said blade-mounting face in a transverse direction relative to said blade-mounting face and that extends along the length of said blade-mounting face so as to divide said blade-mounting face into opposite first and second mounting-portions, said positioning groove being defined by a groove-confining wall; and a flexible elongated blade having a first side portion attached to said first mounting-portion, a second side portion attached to said second mounting-portion, an intermediate portion interconnecting said first and second side portions and disposed over and aligned with said positioning groove, and a plurality of spaced apart positioning tabs which are aligned along the length of said positioning groove, which project from said intermediate portion into said positioning groove, and which abut against said groove-confining wall so as to enhance positioning of said blade at said block piece prior to fastening of said blade to said block piece.

2. The cutter of claim 1, wherein said block piece is rotatable about a rotation axis, said blade-mounting face being helically twisted about said rotation axis, said first side portion of said blade being formed with a cutting edge, said blade being formed with a plurality of spaced apart notches which are aligned along the length of said blade, each of said notches extending from said second side portion of said blade toward said first side portion of said blade so as to divide said intermediate portion into a plurality of spaced apart tab-connecting sections that are aligned along the length of said blade, so as to divide said second side portion into a plurality of spaced apart attaching sections that are aligned along the length of said blade and that are attached to said second mounting-portion of said blade-mounting face, and so as to enhance flexibility of said blade for conforming to the helical shape of said blade-mounting face, said groove-confining wall including a base portion confronting said intermediate portion of said blade and having two opposite ends, and two opposite side portions that transversely and respectively extend from said opposite ends of said base portion, each of said positioning tabs being bent from a respective one of said tab-connecting sections of said intermediate portion, projecting inclinedly therefrom into said positioning groove, and having two opposite sides that abut respectively against said opposite side portions of said groove-confining wall.

3. The cutter of claim 2, wherein said base portion of said groove-confining wall is formed with a plurality of screw holes that are aligned with said notches, respectively, said cutter further comprising a plurality of fastening plates which are attached to and which are aligned in series along the length of said blade, and a plurality of screw bolts extending through said fastening plates and said notches and threadedly and respectively engaging said screw holes so as to fasten said blade to said block piece.

4. The cutter of claim 1, wherein said block piece is rotatable about a rotation axis, said blade-mounting face being helically twisted about said rotation axis, each of said first and second side portions of said blade being formed with a cutting edge, said blade being formed with a plurality of alternately disposed first and second notches which are aligned along the length of said blade, each of said first notches extending from said second side portion of said blade toward said first side portion of said blade, each of said second notches extending from said first side portion of said blade toward said second side portion of said blade, said first and second notches dividing said intermediate portion into a plurality of spaced apart tab-connecting sections that are aligned along the length of said blade, dividing said first side portion into a plurality of spaced apart first attaching sections that are aligned along the length of said blade and that are attached to said first mounting-portion of said blade-mounting face, dividing said second side portion into a plurality of spaced apart second attaching sections that are aligned along the length of said blade and that are attached to said second mounting-portion of said blade-mounting face, and enhancing flexibility of said blade for conforming to the helical shape of said blade-mounting face, said groove-confining wall including a base portion confronting said intermediate portion of said blade and having two opposite ends, and two opposite side portions that transversely and respectively extend from said opposite ends of said base portion, each of said positioning tabs being bent from a respective one of said tab-connecting sections of said intermediate portion, projecting inclinedly therefrom into said positioning groove, and having two opposite sides that abut respectively against said opposite side portions of said groove-confining wall.

* * * * *